United States Patent [19]

Marzoli

[11] 4,161,863

[45] Jul. 24, 1979

[54] ROTARY RING FOR SPINNING AND TWISTING RING MACHINES

[75] Inventor: Angelo Marzoli, Palazzolo Sull'Oglio, Italy

[73] Assignee: F. lli Marzoli & C. S.p.A., Palazzolo Sull'Oglio, Italy

[21] Appl. No.: 882,692

[22] Filed: Mar. 2, 1978

[30] Foreign Application Priority Data

Mar. 2, 1977 [IT] Italy ..... 20838 A/77
Jan. 27, 1978 [IT] Italy ..... 19716 A/78

[51] Int. Cl.[2] ..... D01H 7/56
[52] U.S. Cl. ..... 57/124; 57/122
[58] Field of Search ..... 57/118, 121, 122, 124, 57/125, 75

[56] References Cited

U.S. PATENT DOCUMENTS

| | | | |
|---|---|---|---|
| 795,476 | 2/1900 | Belanger | 57/124 |
| 1,204,346 | 11/1916 | Dearborn | 57/124 |
| 1,495,636 | 5/1924 | Feaster | 57/124 |
| 3,981,135 | 9/1976 | Huber et al. | 57/124 |

FOREIGN PATENT DOCUMENTS

| | | | |
|---|---|---|---|
| 71775 | 5/1916 | Fed. Rep. of Germany | 57/124 |
| 29666 | of 1907 | United Kingdom | 57/124 |
| 1000365 | 8/1945 | United Kingdom | 57/124 |

*Primary Examiner*—Donald Watkins
*Attorney, Agent, or Firm*—Karl W. Flocks

[57] ABSTRACT

In a ring spinning and/or twisting frame, to prevent overheating of the traveller and the yarn treated thereby and also to suppress as far as possible the top limits to the speed of rotation of the spindles, a rider having a ringlike shape and having a surface portion intended to be slid on the body of the stator of the ring being hooked to the rotor body of the ring, said rider being also provided with a portion spaced apart from the sliding portion and intended to allow the yarn being processed to run therethrough.

The invention has a number of embodiments, a fair number of which are illustrated. Aerodynamic means are also provided to equip said rider for providing a braking action therefor.

15 Claims, 27 Drawing Figures

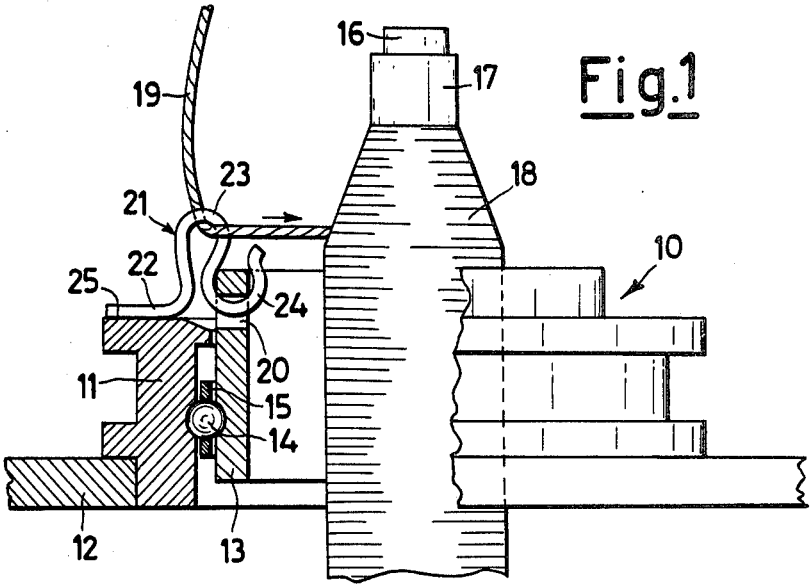
Fig.1
Fig.2
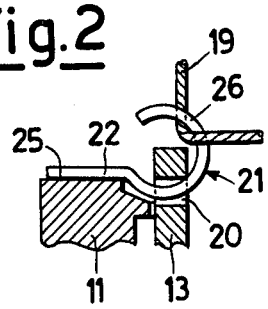
Fig.4
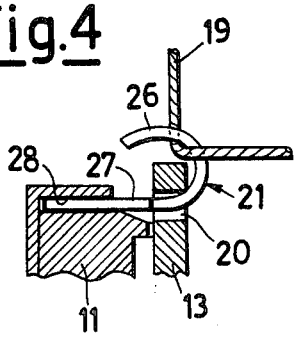
Fig.3
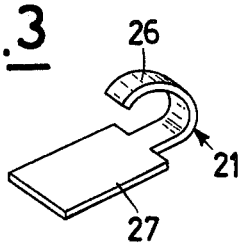
Fig.5
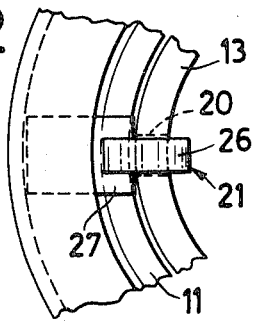

Fig.14
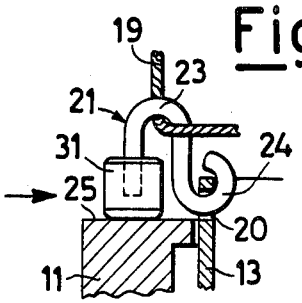
Fig.15
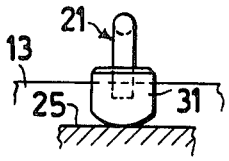
Fig.16
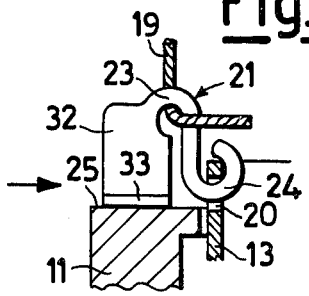
Fig.17
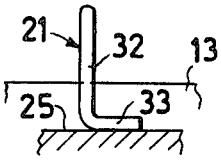
Fig.18
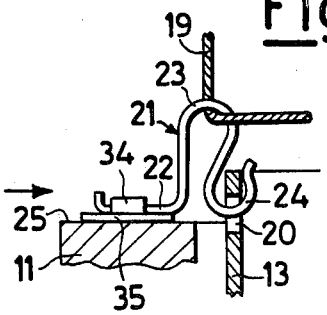
Fig.19
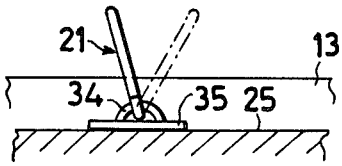
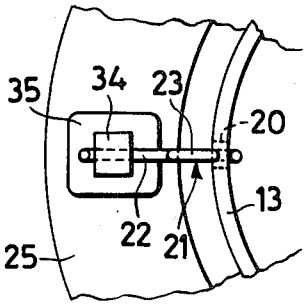
Fig.20

ROTARY RING FOR SPINNING AND TWISTING RING MACHINES

This invention relates to the spinning and twisting ring-machines which, in the ensuing description will be called for short ring spinning machines and relates particularly to the rings used in machines of this kind.

It is known that in the conventional ring frames the rings are fixed, that is to say, stably mounted on the bench or ring-carrier, on each ring there being a small ring or traveller which is the twisting member for impressing the desired twist to the yarn being spooled. This traveller is driven to rotation by the tension of the yarn which is passed therethrough and is wound on the cop which is slipped onto the quickly rotating spindle.

As a result, also the traveller attains in its sliding on the ring a high peripheral speed which is such as to originate heavy specific loads per unit of surface and these, in their turn, are such as to bring about a considerable heating of the traveller and thus a rapid wear thereof, frequent replacements being thus required. In addition, heat-sensitive yarns are exposed to damages when in contact with the heated traveller.

These and other reasons have placed a limit which can be only hardly overtaken as regards the rotation speed of the spindles and thus the output of the conventional ring frames.

An attempt towards doing away with the hindrances and improving the working conditions of the ring frames has been made in order to increase the output of the frame, and among the several suggestions, particular mention is deserved by those which provide for adopting rotary rings of the so-called self-rotating type, instead of the fixed rings. In practice, it has been envisaged to suspend in a rotatable way the conventional ring with the traveller thereon so as to reduce, by virtue of the rotation of the ring, the sliding speed of the traveller on the ring, the speed of rotation of the spindle being the same.

The results which have been so obtained are far from being satisfactory. The rotary ring, due to its considerable mass and inertia originates considerable difficulties especially if one considers the absolute requirement that the overall speed of rotation of the rotary ring and of the traveller on the ring must, at every instant, be slightly below the speed of rotation of the spindle in order to ensure that the yarn is spooled on the spool mounted on the spindle.

In addition, since the traveller is slidable on the ring, it remains prone of frictional heating so that the problems inherent in the heat-sensitive yarns are far from being solved.

An object of the present invention, in the main, is to do away with such drawbacks and to provide a rotary ring for spinning and twisting frames which permits considerable increase in the speed of rotation of the spindles while constantly ensuring the condition of a speed which is slightly below, for the ring, that of the spindle and makes possible the processing even of heat-sensitive yarns.

To solve these problems, it has been thought to equip the rotor annular body of the ring, rather than with a traveller slidable thereon, with a rider in the form of a small ring or like member, to be hooked to said annular rotor and to shape such a rider in such a way that a part of it slides on a surface of the stator body to which the rotor body is concentrically coupled for rotation, while another portion of said rider, far from such sliding portion, is so shaped as to permit that the yarn being processed may run therethrough.

By so doing, the ring-shaped rider fulfils two important requirements, viz.:

(1) It exerts a braking action between the rotary body and the stator body of the ring so that the speed of rotation of the rotor body is always slightly below the speed of rotation of the spindle, and (2) It maintains the running yarn far from the area which, as a result of the sliding action on the stator body, could reach high temperatures, thus allowing the processing at a high speed even of heat-sensitive yarns.

Such a rider can comprise, more particularly, a portion which is directed outwardly and is intended to slide on a surface of the stator body of the ring, and a curled portion which can be hooked to the rotor body of the ring and is adapted to permit, in the vicinity of the hooking spot, the run of the yarn. The curled portion, which is hooked, for example, in a hole of the rotor body, presses, due to the action of centrifugal force, against the internal surface of said body.

In order to obtain that such rider may fulfil its function of exhibiting its braking action, it is required that the resultant of the forces to which it is subjected in operation be directed towards the sliding countersurface of the stator body of the ring so as to maintain the sliding portion aforesaid of the rider in contact with said surface and that the point of action of such resultant force is displaced towards the outside.

The forces which are active upon such rider in motion and which, as a whole, supply such a resultant, are the tension of the yarn between the rider and the spool, the tension of the yarn due to "ballooning", the weight of the rider, the centrifugal force to which it is subjected, and the frictional force on the stator body.

The braking action of such rider is extremely important to the ends of the satisfactory operation of the rotary rings and distinguishes the approach of this invention over the conventional ones.

It is to be borne in mind, that, as the coiling diameter of the spool is increased, it is required that the difference between the speeds of rotation of the ring and the spindle is decreased in order that the twist of the yarn during the formation of the spool may remain almost constant. This means that the braking action of the rider hooked to the rotor body and sliding on the stator body must be such that the two extreme speeds of rotation of the rotor body, that is the speed during the spooling of the yarn on the empty cop and during the spooling of the yarn on a nearly full cop differ from the speed of rotation of the spindle by no more than 2%, and preferably no more than 1 to 2%.

This is obtained by a proper shaping of the rider and an appropriate selection of its size.

When rings having a diameter over about 60 mm are involved, such rings being used for processing high-count yarns or twisted yarns, the sliding portion of the ringlike rider hooked to the rotor body can be exposed to premature wear. This can be explained by the fact that in such a case the forces acting upon the ringlike rider reach a considerable magnitude and thus the resultant of these forces has a considerable magnitude.

In order that the ideas exposed in the foregoing may be applied also to rings having a diameter over about 60 mm. the present invention provides in such a case to make with a wear-resistant material the sliding portion of the rider which is hooked to the rotor body of the ring.

As an alternative, or in addition, to the foregoing, the rider can also be equipped with a portion which, during the rotation at high surface speeds, causes the resistance of the air to be exalted while reducing the magnitude of the resultant of the forces which are active upon the rider.

Further features and advantages of the invention will become more clearly apparent from the description of a few embodiments which are shown by way of suggestive example without limitation in the accompanying drawings. In the drawings:

FIG. 1 shows, for one half in cross-section and for the other half in elevational view a rotary rider according to the invention.

FIG. 2 shows a fragmentary view of another embodiment of the ring with the rider hooked to the rotary portion hooked in a different way.

FIG. 3 is a perspective view of another embodiment.

FIGS. 4 and 5 are partial views, in cross-section and in plan view, how the rider of FIG. 3 is applied to the rotary ring.

FIG. 14 shows, similarly to FIG. 2, a rider hooked to the rotary body with the sliding portion made of a wear-resistant material.

FIG. 15 is a view taken along the direction of the arrow of FIG. 14.

FIG. 16 shows, similarly to FIG. 2, still another embodiment of the rider hooked to the rotary body.

FIG. 17 is a view taken along the arrow indicated in FIG. 16,

FIGS. from 18 to 20 show, in cross-section as in FIG. 2, in side view along the arrow indicated in FIG. 18 and in plan view, respectively, yet another embodiment of said rider.

Figure 21:
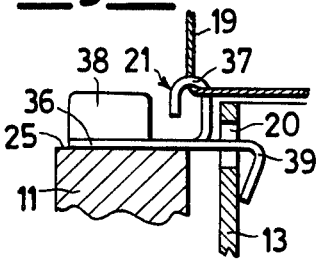
Figure 22:
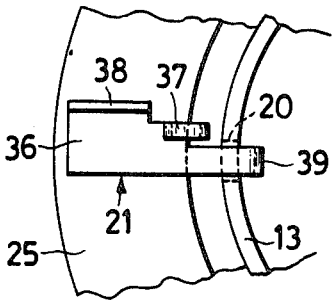

FIGS. 21 and 22 show in cross-section as in FIG. 2 and in plan view, respectively, still another embodiment of the rider hooked to the rotary body.

Figure 27:
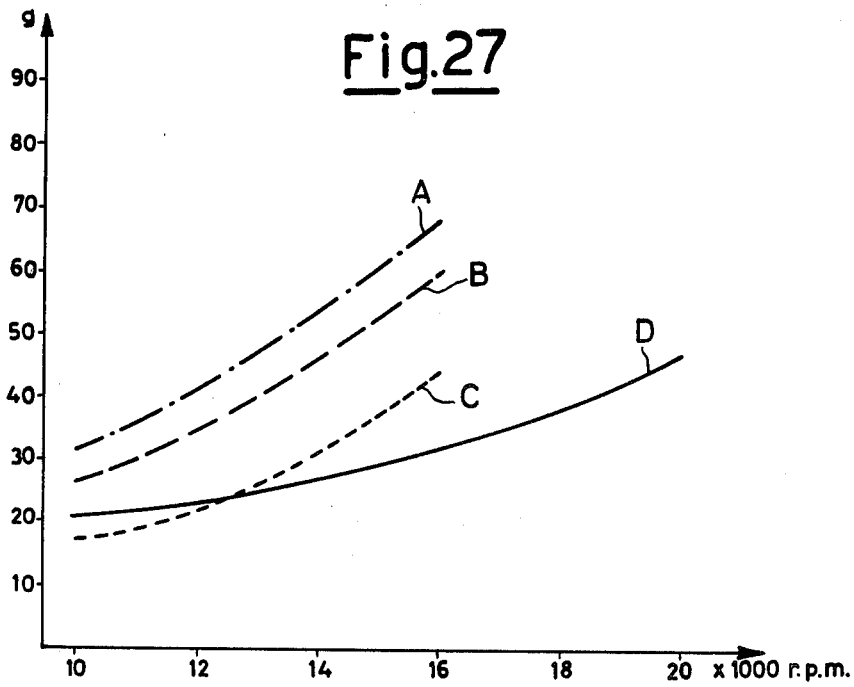

FIGS. 23–24 and 25–26 show simiarly to FIGS. 14–15 additional embodiments of said rider, and FIG. 27 shows a plot of the average tensions of the yarns as a function of the RPMs of the spindles in a comparison of the rider according to the invention with conventional rings.

As can clearly be seen in FIG. 1, the rotary ring according to the invention, generally indicated at 10, comprises an annular stator body 11, fastened to the bench or ring-carrier carriage 12 and an annular rotor body 13 which is concentrically coupled for rotation to the stator body by means of a string of balls 14, retained by a cage 15. At the center of the ring 10 and coaxially therewith there is the spindle 16 on which a cop 17 is placed for the formation of a bobbin cop 18 of yarn. The yarn 19 to be spooled on the cop comes, conventionally, from a draw-frame and a thread guide (not shown).

The top of the rotor body 13 of the ring has a hole or slot 20 into which a rider 21 shaped in quite particular a way, is hooked.

In the embodiment depicted in FIG. 1, the rider 21 displays a planar portion 22 and a twin-curled portion 23, 24. The curled portion 24 of 21 is hooked into the hole 20 of the rotor body 13, whereas in the eye 23 the yarn 19 runs and goes to the bobbin 18 and the planar portion 22 slides on a top surface 25 of the ring stator body 11.

During the rotation of the spindle 16, due to the centrifugal effect, the curled portion 24 of the rider 21 goes to press against the inner surface of the rotary body 13, whereas, by virtue of the resultant of the forces active upon 21, the outwardly projecting planar portion 22 rests against and slides on the top surface 25 of the stator body 11, thus bringing about the braking action.

It can be seen that the bent portion 23 of 21 which receives the yarn 19 when running, is near the point of hooking of 21 and is far from the area in which the sliding member slides on the stator body, so that the yarn is not exposed to any overheating hazard.

The rider 21 hooked to the rotary body 13 of the ring 10 can take another form.

Thus, in the embodiment of FIG. 2, the rider 21 has still a planar portion 22 projecting outwardly and intended to rest against the planar top surface 25 of the stator body 11, whereas it has a portion 26 which is merely bent in the shape of a C by which the rider 21 is hooked into the hole 20 of the rotor body 13 and through which the yarn 19 is allowed to pass.

The embodiments illustrated in the FIGS. from 3 to 8 of the drawings are similar to that of FIG. 2, but the planar portion 27 of 21 is wider than the portion 26 bent in the shape of a C.

According to the embodiment shown in FIGS. from 3 to 5, the widened planar portion 27 of 21 is freely slipped into a circumferential slit 28 formed through the stator body 11 of the ring so that the rider 21 is guided in its rotation and the braking action can be impressed to both the opposite surfaces of the slit.

In the embodiment depicted in FIGS. from 6 to 8, rider 21 has, in addition, two flexible tabs 29 and is intended to become hooked from the inside into the hole 20 of the rotor body 13. On completion of the introduction, the tabs 29 prevent the hooked-in rider from being unthreaded.

Figure 6:
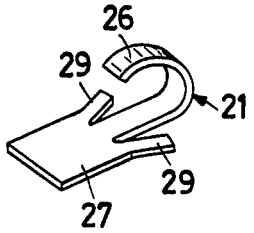
FIG. 6 shows a further embodiment of the rider which is to be hooked to the rotary portion of the ring.
Figure 7:
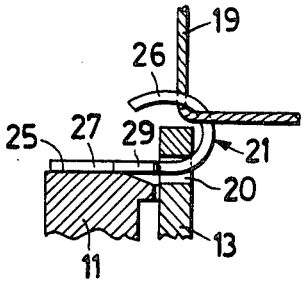
FIGS. 7 and 8 are views similar to those of FIGS. 4 and 5 of the manner in which the rider of FIG. 6 is applied.
Figure 9:
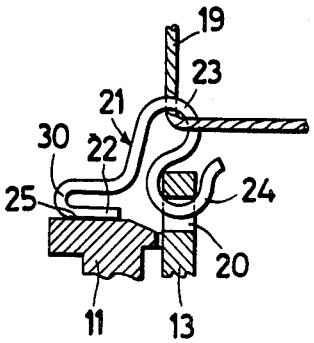
FIG. 9 shows yet another embodiment of the rider which is hooked to the rotary portion of the ring.
Figure 8:
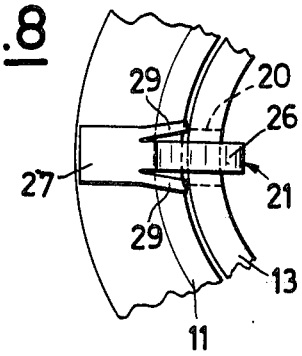

Yet another embodiment of the rider 21 is shown in FIG. 9. It is akin to that of FIG. 1, but for the protruding planar portion 22 intended to slide on the surface 25 of the stator body, said portion 22 being formed as an end ledger of another curled portion of 21.

Figure 10:
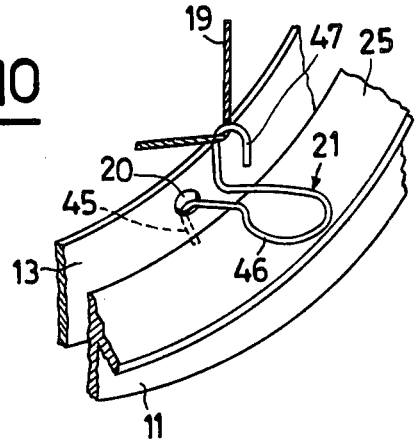
FIG. 10 is a perspective view of still another embodiment of such rider.

In the embodiment shown in FIG. 10, the rider 21 has a hook 45 by which it is hooked in the hole 20 of the rotary body 13, a nooselike portion 46, by which it slides on the surface 25 of the stator body 11, and also a second hook 47 through which the yarn 19 runs. The nooselike portion 46 is comparatively broad and stays on a plane perpendicular to that of the hooks 45 and 47.

Figure 11:
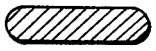
FIGS. 11, 12 and 13 show three different cross-sectional views of riders to be hooked to the rotary portion of the ring.
Figure 12:
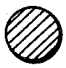
Figure 13:
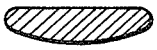

Rider 21 can be formed by stamping, bending and similar oper-ations from steel sections which can take a number of outlines, such as flat with rounded corners (FIG. 11), round (FIG. 12), or half-round (FIG. 13, and, in addition, the pieces can undergo an appropriate heat treatment in order that an adequate hardness may be imparted thereto.

The embodiments of the rider 21 which will be described hereinafter with reference to FIGS. from 14 to 26 are especially suitable for rings having a large diameter (about 60 mm and over) intended for processing coarse yarns or twisted yarns.

In the embodiment shown in FIGS. 14 and 15, rider 21 has a twin-bend portion 23–24, the curled portion 24 being hooked into the hole 20 of the rotor body 13 with the yarn 19 going to the bobbin by running through the curled section 23. Rider 21 is made of a smooth hard material, such as tempered steel and the free end of the bend 23 carries a body 31, which, with its rounded bottom surface slides on the surface 25 of the stator body 11. The cylindrical body 31 is made of a wear-resistant material such as a ceramic of sintered alumina. Its bottom surface is rounded so that no sharp edge may contact the surface 25, even if the rider 21 becomes inclined relative to the surface 25, for example, due to the effect of forces to which it may become subjected during rotation.

If desired, the planar surface 25 itself of the stator body 11 of the ring can be coated by a wear-resistant material.

In the embodiment of FIGS. 16–17, rider 21 still displays a twin-curl portion 23, 24 having the same task as outlined above, whereas its portion intended for sliding on the surface 25 is shaped in the form of a tab 32 having a ledger 33 which contacts the surface 25. If desired, the tab 32 can be embodied also without any ledger such as 33.

During the rotation of rider 21, the tab such as 32 offers a certain resistance to the air so that a force is originated, which tones down the magnitude of the resultant of the forces acting upon the rider 21. By so doing, the wear to which the sliding portion of rider 21 is subjected is reduced especially when 21 is rotated at high surface speeds.

Rider 21 as embodied in FIGS. 18–20 is of the nature of that depictd in FIGS. 14–15 but has a planar portion 22 to which is applied, by the agency of a slot 34, a planar sliding body 35 made of a wear-resistant material which rests against the surface 25. As can be seen in FIG. 19, the rider 21 can be arranged on a plane which is at a slope relative to the planar body 35.

FIGS. 21–22 show another embodiment of rider 21 hooked in the hole 20 of the rotary body 13. Such a rider 21 is composed by a planar plate 36 from which project upwardly a crook 37 through which the yarn 19 can be passed and a tab 38 and, downwardly, another crook 39 by means of which the tab is hooked in the hole 20. The tab 38 fulfils the same task as the tab 32 of the member shown in FIGS. 16–17.

The rider 21 according to the embodiments shown in FIGS. 23–24 and 25–26 are similar to that of FIGS. 18–20 and the difference therefrom is the different configuration of the sliding body made of a wear-resisting material as applied to the planar portion 22.

Figure 23:
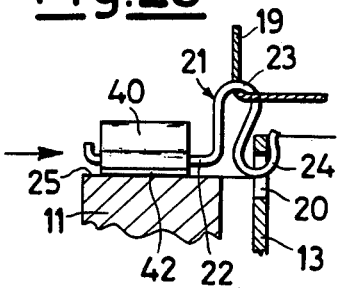
Figure 24:
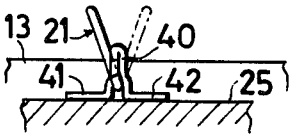

In the example shown in FIGS. 23–24, the sliding body is a bent plate having a central double portion 40 positioned perpendicularly to the surface 25 and two planar tabs 41, 42 which contact the surface 25. The central portion 40 has the function of the tab 32 of the rider 21 of FIGS. 16–17 and increases the resistance to air during rotation thus reducing the resultant of the forces which act upon the rider 21. Rider 21 can be arranged at an angle relative to the body 40–42 as shown in FIG. 24.

Figure 25:
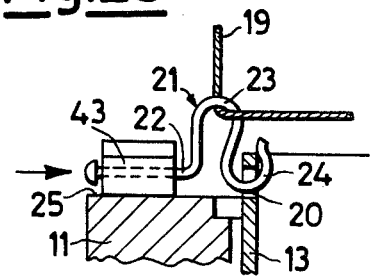
Figure 26:
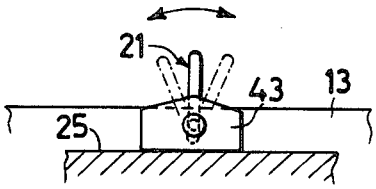

In the example shown in FIGS. 25–26, the sliding body 43 has a prismatic form with a planar base contacting the surface 25, the top surface having a twin slope like a roof and a central bore through which 21 is allowed to pass with a certain clearance, the result being that the portion 22 of 21, i.e. the shank, can be inclined realtive to 43, as shown in FIG. 26. Also 43, in addition to being made of a wear-resisting material, offers a certain resistance to air, so that the resultant of the forces acting upon 21 is reduced thereby.

Be it understood that the several embodiments shown and described in the drawings are in no wise limitations and a number of modified embodiments can be envisaged without departing from the basic general ideas of the present invention.

The advantages afforded by the rotary rider according to the invention can now be fully appreciated from the foregoing disclosure.

It must be added, however, that by an appropriate sizing of parts, the specific pressure of the rider 21 against the sliding surface 25 of the stator body becomes a great deal lower than the specific pressure impressed by a conventional traveller which runs on the ring, so that also the tension of the yarn being spooled is less than that which is experienced when working with the conventional travellers.

A comparative test has been carried out between a conventional ring with three standard types of travellers and a rider according to the invention equipped with a member hooked to the rotary body as shown in FIG. 1. At various values of the rotational speed of the spindle, there have been measured by using an electronic tension meter, the values of the tension of yarn at a location X on the diameter of the cop and at a location Y on the filled-bobbin diameter.

In the test there has been used a yarn having the following specifications:

Material:Sudan cotton
Staple length:36 mm
Processing:twisted
Count:Ne=56/2, equivalent to tex 10,5/2
Twists:2565 turns per inch, equivalent to 1010 RPM Cops have been employed which were 280 mm tall, had a base diameter of 28 mm and a tip diameter of 22 mm, the diameter of the spooled up cop being 43 mm.

Conventional Ring

Inside diameter:50mm
Flange:conventional number 1, equal to a top dimension of 3.2 mm Standard Travellers (A) English number 5/0 equal to ISO Number 35.5 (weight 0.0355 g)
(B) English Number 1/0 equal to ISO Number 56 (weight 0.056 g)
(C) English Number 2 equal to ISO Number 71 (weight 0.071 g)

Rider According to the Invention

Inside diameter of the rotor body:55 mm
(D) Member hooked to the rotor body according to FIG. 1 hereof:weight 0.07 g.

The following TABLE shows the values of the yarn tension as measured at the locations X and Y as defined above, as well as the average values.

TABLE

| Spindle | Traveller A | | | Traveller B | | | Traveller C | | | Rider D | | |
|---|---|---|---|---|---|---|---|---|---|---|---|---|
| speed,RPM | X | Y | $\frac{X+Y}{2}$ | X | Y | $\frac{X+Y}{2}$ | X | Y | $\frac{X+Y}{2}$ | X | Y | $\frac{X+Y}{2}$ |
| 10.000 | 28 | 36 | 32 | 23 | 29 | 26 | 15 | 18 | 16.5 | 18 | 23 | 20.5 |
| 12.000 | 38 | 47 | 42.5 | 31 | 39 | 35 | 20 | 24 | 22 | 20 | 26 | 23 |
| 14.000 | 49 | 59 | 54 | 41 | 53 | 47 | 27 | 37 | 32 | 24 | 31 | 27.5 |
| 16.000 | 61 | 75 | 68 | 52 | 68 | 60 | 36 | 52 | 44 | 28 | 36 | 32 |
| 18.000 | | | | | | | | | | 32 | 43 | 37.5 |
| 20.000 | | | | | | | | | | 40 | 52 | 46 |

It should be noticed that with the standard travellers A, B and C there have been measured the values of the tension up to the spindle speed of 16,000 RPM, since, at such a speed, with a 50 mm diameter of the ring, the peripheral or surface speed of the traveller is 41.87 m/sec., that which is a limiting speed, beyond which the travellers are burned out by overheating.

The spindle speed of 20,000 RPM is by no way a maximum limit for the rider according to the present invention.

FIG. 27 is a plot of the average values of the tension for the conventional ring with the travellers A, B and C for the rider according to the invention with rider D hooked to the rotor body.

It can clearly be appreciated that the tension trend for the rider according to this invention is much more attractive than that for the conventional travellers.

The decreased yarn tension minimizes the hazard of yarn breaks during processing.

Such a hazard is further reduced since during the starting stage of the rotation of the spindles, the portion of the rider hooked to the rotor body and which is intended to slide on the stator body, by virtue of the initial tension of the yarn, virtually does not touch the stator body so that jerks and overtensions of the yarn are effectively preveted.

I claim:

1. A rotary ring for spinning and twisting frames of the ring class, comprising a spindle-carrying carriage on the frame, an annular stator body fastened to said spindle-carrying carriage, an annular rotor body concentrically connected for rotation to said stator body, characterized by a rider having substantially the shape of a small ring which is hooked to said rotor body and has a portion intended for sliding on a surface of said stator body and a portion spaced apart from said sliding portion and so shaped as to permit the passage of the yarn being processed.

2. A rotary ring according to claim 1, characterized in that said rider comprises said sliding portion having a planar portion projecting outwardly for resting against the surface of the stator body and at least a bent portion for hooking said rider to the rotor body and allowing the yarn to pass therethrough.

3. A rotary ring according to claim 2, characterized in that the bent portion is crooked in the shape of an S.

4. A rotary ring according to claim 2, characterized in that the planar portion is wider than the bent portion.

5. A rotary ring according to claim 4, characterized in that said stator body has a slit formed therethrough and said wider planar portion is inserted into said slit formed through said stator body.

6. A rotary ring according to claim 4, characterized in that starting from the widened planar portion and at the sides of the bent portion said rider has two flexible locking tabs to prevent the release of said hoooked rider from said rotor body.

7. A rotary ring according to claim 2, characterized in that the planar portion is formed in the shape of an end-ledger of a further bent portion of said rider.

8. A rotary ring according to claim 1, characterized in that the sliding portion of said rider is made of a wear-resistant material.

9. A rotary ring according to claim 1, characterized in that said rider hooked to the rotor body has a portion which during the rotation of the rider offers a high resistance to air thus reducing the resultant of the forces which act upon said rider.

10. A rotary ring according to claim 8, characterized in that the sliding portion is rotatably connected to the rider hooked to the rotor body.

11. A rotary ring according to claim 8, characterized in that the sliding portion is fastened to the rider hooked to the rotor body and presents a rounded surface contacting the sliding surface of the rotor body.

12. A rotary ring according to claim 8 characterized in that the sliding portion of a wear-resistant material of the rider hooked to a rotary body constitutes also the portion which offers a high resistance to air during the rotation of the rider.

13. A rotary ring according to claim 1, characterized in that the rider is obtained from a steel section having a flat, a round outline.

14. A rotary ring according to claim 1, characterized in that the rider is obtained from a steel section having a round outline.

15. A rotary ring according to claim 1, characterized in that the rider is obtained from a steel section having a half-round outline.

* * * * *